United States Patent [19]

Benis

[11] 4,296,766

[45] Oct. 27, 1981

[54] MANICURING CASE AND SUPPORTING APPARATUS

[76] Inventor: Isak Benis, 525 N. Kings Rd., Los Angeles, Calif. 90048

[21] Appl. No.: 167,817

[22] Filed: Jul. 14, 1980

[51] Int. Cl.[3] ..... A45D 29/00

[52] U.S. Cl. ..... 132/73; 132/73.5

[58] Field of Search ..... 132/73, 73.5, 75

[56] References Cited

U.S. PATENT DOCUMENTS

| | | | |
|---|---|---|---|
| D. 118,830 | 2/1940 | Newman | 132/73 UX |
| 2,171,804 | 9/1939 | Perez | 132/73 |
| 2,392,626 | 1/1946 | Young | 132/73 |
| 2,842,141 | 7/1958 | Rodrigues, Jr. | 132/73.5 |
| 3,665,867 | 5/1972 | Carlson | 132/73.5 |

*Primary Examiner*—G. E. McNeill

[57] ABSTRACT

A manicuring case and supporting apparatus for storing manicuring implements and providing a base of support for a user's hand during use thereof. A container defines an interior cavity and includes a plurality of apertures in the top surface thereof. Each aperture is adapted to receive a bottle of polish or the like and is configured to preclude the bottle from being inadvertently dislodged irrespective of the orientation of the case. A supporting base depends upwardly from the top surface of the container. The supporting base includes an arcuate member which has a plurality of concave depressions disposed in the top surface thereof. The concave surfaces are substantially parallel to each other and provide a base upon which the user's hand can be disposed during use of the present invention.

5 Claims, 4 Drawing Figures

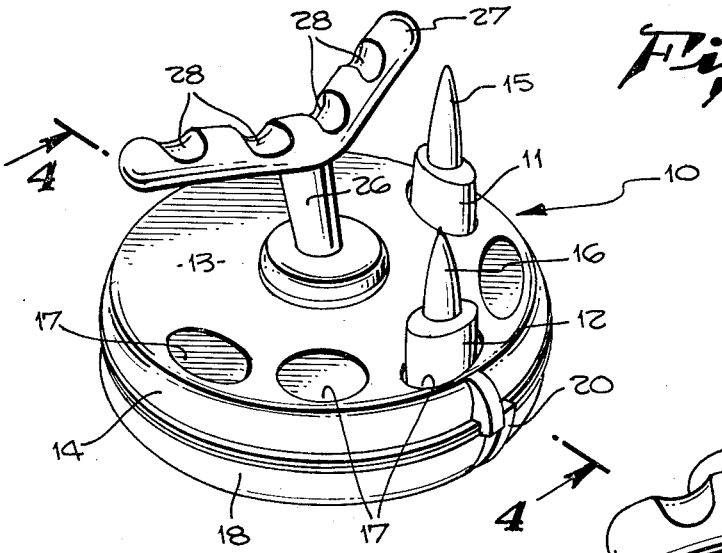
Fig. 1.
Fig. 2.
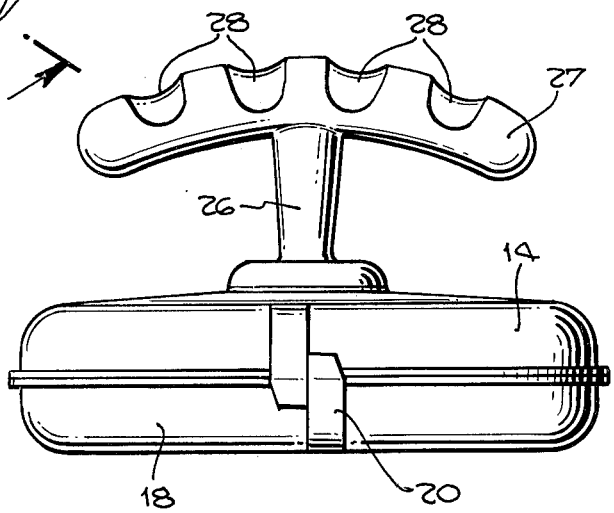
Fig. 3.
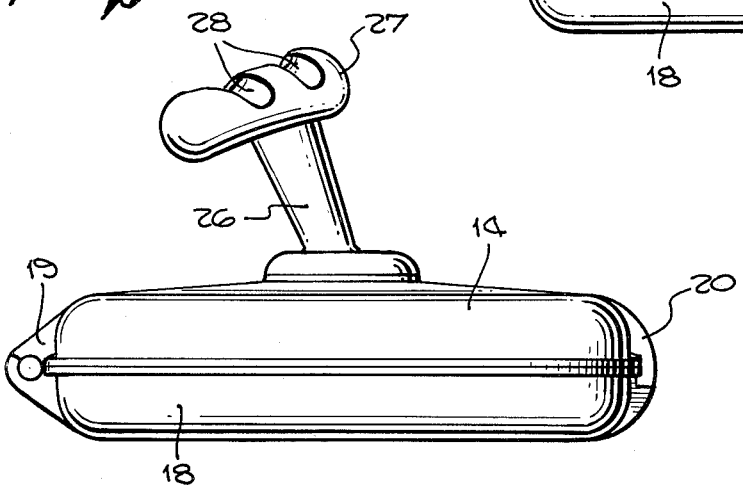
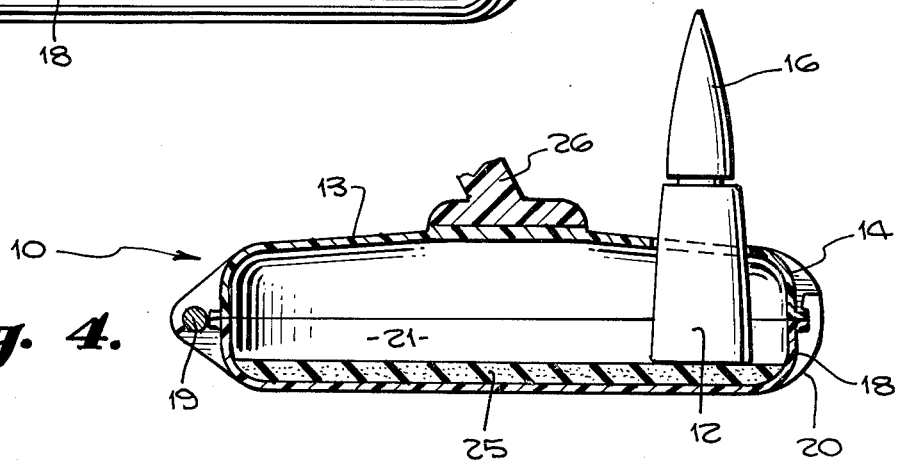
Fig. 4.

MANICURING CASE AND SUPPORTING APPARATUS

BACKGROUND OF THE INVENTION

1. Field of the Invention

The present invention generally relates to manicuring aids and, more particularly to a combined case and apparatus which holds manicuring implements and provides a base upon which the user's hand can be supported during use thereof.

2. Prior Art

The use of aids for manicuring hands have been well-known for centuries. Simple cases or containers used to hold bottles, brushes, files, etc., have long been disclosed and known to the public. On the other hand, the basic problems incident to the use of such devices are inherent in their inability to attack the physical requirements imposed by a manicuring procedure.

The requirements which the present invention are directed relate to: (1) the ability to store and present for use a plurality of containers holding polish, polish remover, etc.; (2) a base upon which the user's hand can be placed during the manicuring procedure. As stated, the failure to attach these basic problems provides the impetus for the present invention.

The present invention substantially resolves the problems left unsolved by the devices disclosed in the prior art. A container defines an interior cavity within which the manicuring implements are stored. The top of the container has a plurality of openings or apertures therein which provide access to bottles of polish, polish remover and the like. The conventional configuration for commercially available polish containers is defined by a tapered profile which provides for a substantially uniform decrease in the cross-section geometry at the upper portion of the bottle. When using bottles having such a profile, the container which comprises a portion of the present invention is opened and the appropriate bottles inserted upwardly through the tops of the container in the apertures defined therein. When the container is closed, the polish bottles cannot be dislodged since the portion of the bottle within the container has a greater cross-section than the aperture in the top surface of the container. When the container is in a closed position, the polish can be mixed or otherwise agitated without fear of dropping the bottles since they cannot be inadvertently dislodged from the container.

An upwardly depending supporting base employs an arcuate member having a plurality of depressions in the top surface thereof. The depressions are substantially parallel to each other and provide a basis upon which the user can rest his or her fingers during the manicuring procedure.

SUMMARY OF THE INVENTION

The present invention comprises a case and supporting apparatus used in manicuring nails. The invention comprises a container which defines an interior cavity and has a top and bottom surface which are substantially parallel to one another. A plurality of apertures are disposed in the top surface and are spaced in a uniform manner along a portion of the periphery of the top surface. Bottles of polish or other liquid used with the present invention utilize a profile which exhibit a uniformly decreasing cross-section at the upper portion of the bottle. The polish bottles are inserted through the apertures from the interior of the container and are maintained in position by the opposing forces created by the top and bottom of the container against the respective surfaces of the bottles. A supporting base depends upwardly from the top surface of the container. In order to maintain stability of the user's hand during manicuring, the supporting base employs an arcuate member which is similar in curvature to that defined by the tips of the fingers of a human hand. A plurality of concave depressions are disposed in the top surface of the supporting member, the depressions being substantially parallel to one another. The depth of the depressions are sufficient to allow the user's fingers to be disposed thereon in a stable manner and thereby avoid inadvertent movement while polish is being applied.

It is therefore an object of the present invention to provide a manicuring case and supporting apparatus which stores polish bottles in position for use.

It is another object of the present invention to provide a manicuring case and supporting apparatus which provides for liquid agitation while precluding inadvertent dislodgment of the stored liquid.

It is yet another object of the present invention to provide a manicuring case and supporting apparatus which provides for stable positioning of the user's hand during manicuring.

It is still yet another object of the present invention to provide an improved manicuring case and supporting apparatus which is simple and inexpensive to fabricate.

The novel features which are believed to be characteristic of the invention, both as to its organization and method of operation, together with further objectives and advantages thereof, will be better understood from the following description considered in connection with the accompanying drawing in which a presently preferred embodiment of the invention is illustrated by way of example. It is to be expressly understood, however, that the drawing is for the purpose of illustration and description only and is not intended as a definition of the limits of the invention.

BRIEF DESCRIPTION OF THE DRAWINGS

FIG. 1 is a front, perspective view of the present invention manicuring case and supporting apparatus illustrating stored polish bottles.

FIG. 2 is a front elevation view of the present invention manicuring case and supporting apparatus.

FIG. 3 is a side elevation view of the present invention manicuring case and supporting apparatus.

FIG. 4 is a cross-sectional view of the present invention manicuring case and supporting apparatus taken through line 4—4 of FIG. 1.

DESCRIPTION OF THE PRESENTLY PREFERRED EMBODIMENT

An understanding of the present invention can be best gained by reference to FIG. 1 wherein a perspective view of the present invention is shown therein, the manicuring case and supporting apparatus being generally designated by the reference numeral 10. The present invention manicuring case 10 is adapted for use with bottles which are conventionally used to store nail polish, polish remover, etc. The conventional profiles of these bottles exhibits a uniformly tapered cross-section, the cross-section decreasing at the upper portion of the bottles. Although this shape is used to facilitate holding the bottle, the tapered profile is employed by the present invention to preclude inadvertment dislodgment of the containers during use. As shown in FIG. 1, bottles 11 and 12 are shown depending upwardly through the top surface 13 of container top 14. As can be seen in FIG. 1, the caps 15 and 16 of bottles 11 and 12 respectively are accessible to the user of manicuring case 10.

A plurality of apertures 17 are disposed in and uniformly spaced about a portion of the periphery of top surface 13. In the form of the present invention shown in FIG. 1, five apertures 17 are included although the number thereof is a matter of choice. Since the bottles 11 and 12 employed with the present invention incorporate a curved, tapered profile, apertures 17 are substantially oval in shape. It would be obvious to one having skill in the art to adapt the shape of apertures 17 to the cross-sectional configuration of bottles 11 and 12 which utilizes a different geometrical configuration.

The storage of bottles 11 and 12 can be best gained by reference to FIG. 4 wherein a cross-sectional view of the present invention manicuring case 10 is shown. Manicuring case 10 employs container top 14 and container bottom 18 which are pivotally coupled by hinge 19. Although the form of the present invention 10 illustrated in FIG. 1 utilizes a container top and bottom 14 and 18 which are round, the shape of the container components is a matter of choice. By the release of the container clasp 20, container top 14 and container bottom 18 can be pivoted about hinge 19 to expose the interior cavity 21 exhibited in FIG. 4. A layer of sponge rubber 25 or other like resilient material is affixed to the bottom surface of container bottom 18. When bottles 11 and 12 are enclosed within cavity 21 intermediate container top and bottom 14 and 18 respectively, the force imposed by top surface 13 against the surfaces of bottles 11 and 12 will bind bottles 11 and 12 against the resilient surface of layer 25. In addition, the resiliency of layer 25 will preclude bottles 11 and 12 from inadvertently moving within cavity 21 thereby enhancing the stability of the structure.

As discussed previously, a plurality of apertures 17 are disposed through top surface 13 of container top 14. As can be best seen in FIG. 4, the flush fit between bottles 11 and 12 and the portion of top surface 13 defined by aperture 17 precludes inadvertent movement of bottles 11 and 12. In this manner, the liquid within bottles 11 and 12 can be agitated without any inadvertent dislodgment of bottles 11 and 12 from the present invention manicuring case 10.

Supporting flange 26 is secured to and depends upwardly from top surface 13 of container top 14. As can be best seen in FIGS. 3 and 4, although the preferred form of the present invention uses a supporting flange 26 which lies at an oblique angle to top surface 13, the choice is arbitrary. Supporting base 27 is secured to the top of supporting flange 26. Supporting base 27 supplies a physical surface upon which the user can position his or her hands during the manicuring procedure. The supporting base comprises an arcuate member in which each half depends rearwardly from the supporting flange 26, the degree of curvature being substantially the same as is defined by the tips of the fingers of a human hand. Four concave depressions 28 are disposed in the top surface of supporting base 27 for placement of the user's fingers. In use, the user's fingers would be disposed in the depressions 28, stability being maintained by opposing pressure from the user's thumb on the bottom side of supporting base 27. To manicure the thumb nail, the thumb is liad in one of the depressions 28, the opposing pressure being applied by the forefinger on the bottom side of supporting base 27.

It can therefore be seen that the present invention comprises an improved manicuring case and supporting apparatus. The bottles 11 and 12 of nail polish, polish remover, etc., are maintained within manicuring case 10 in a manner which would avoid inadvertent dislodgment. In addition, the liquid contained in the bottles can be agitated simultaneously. Lastly, the user can employ the base 27 to maintain the stability of his or her hands while applying polish to the nails.

I claim:

1. A manicuring case and supporting apparatus for use with liquid storing bottles having a tapered cross-section, said manicuring case and supporting apparatus comprising:

(a) a container having top and bottom members which define an interior cavity therebetween, said top and bottom members being pivotally coupled to one another to provide access to said interior cavity, said top member having a plurality of apertures disposed therethrough which are adapted to receive the liquid storing bottles;

(b) a resilient layer disposed upon and secured to the bottom member within the interior cavity whereby the liquid storing bottles are held in place intermediate said top and bottom members when the top and bottom members are pivoted adjacent one another; and (c) support means for supporting the user's hand depending upwardly from the top member of said container, said support means including a base having a plurality of substantially uniform depressions disposed upon the top surface thereof.

2. A manicuring case and supporting apparatus as defined in claim 1 wherein said apertures are uniform with respect to one another.

3. A manicuring case and supporting apparatus as defined in claim 2 wherein said apertures are uniformly spaced from adjacent apertures and are disposed about a portion of the periphery of said top member.

4. A manicuring case and supporting apparatus as defined in claim 3 wherein said support means comprises a supporting flange depending upwardly from the top member substantially equidistance from said apertures, and a supporting base secured to said supporting flange and spaced from said top member, said supporting base being an arcuate member equally disposed on either side of said supporting flange and having said plurality of depressions disposed upon the top surface thereof.

5. A manicuring case and supporting apparatus as defined in claim 4 wherein said depressions disposed upon the top surface of said arcuate member are substantially parallel to one another.

* * * * *